United States Patent [19]

Chickini, Jr. et al.

[11] 4,247,225

[45] Jan. 27, 1981

[54] ALIGNMENT DEVICE

[75] Inventors: Gerald D. Chickini, Jr., Warren; Gordon F. Musch, Novelty; Donald V. Bailey, Hiram; William E. Bartasevich, Kent, all of Ohio

[73] Assignee: Kamak Corporation, Garrettsville, Ohio

[21] Appl. No.: 72,821

[22] Filed: Sep. 6, 1979

[51] Int. Cl.[3] ..... E21D 20/02

[52] U.S. Cl. ..... 405/260; 24/255 SL; 249/219 R; 405/239; 405/244; 405/259

[58] Field of Search ..... 405/244, 239, 260, 261, 405/262; 249/146, 147, 143, 90, 219 R; 248/71, 216.1, 217.1; 425/468, 127, 128; 24/255 SL, 260, 257

[56] References Cited

U.S. PATENT DOCUMENTS

| | | | |
|---|---|---|---|
| 1,080,283 | 12/1913 | Kenny | 405/239 X |
| 1,403,585 | 1/1922 | Bonelli | 405/239 X |
| 2,119,415 | 5/1938 | Bodge | 249/90 |
| 2,995,328 | 8/1961 | Whitted | 248/71 |
| 3,060,694 | 10/1962 | Holmes | 405/239 |
| 3,354,657 | 11/1967 | Turzillo | 405/244 |
| 3,848,034 | 11/1974 | Schaefer | 264/262 |
| 3,913,187 | 10/1975 | Okuda | 24/255 SL |

FOREIGN PATENT DOCUMENTS

| | | | |
|---|---|---|---|
| 379633 | 10/1923 | Fed. Rep. of Germany | 248/71 |
| 298478 | 1/1929 | United Kingdom | 405/239 |
| 1217413 | 12/1970 | United Kingdom | 405/239 |

*Primary Examiner*—Dennis L. Taylor

*Attorney, Agent, or Firm*—Fay & Sharpe

[57] ABSTRACT

An alignment device adapted to position an elongated member such as a cable or the like within the interior of an associated enclosure. The device includes a hollow collar adapted to be placed in a close surrounding relationship with an axial section of the elongated member. The collar includes a longitudinal split in the side wall thereof between opposed spaced apart collar peripheral ends. These ends may be moved apart from each other for installing the device on the elongated member and then moved back toward each other to place the device in a close surrounding operative position thereon. An adjustable locking means facilitates locking the collar at the peripheral ends in the operative position and simultaneously prevents axial displacement of the peripheral ends relative to each other. A plurality of supporting legs extend outwardly of the collar at spaced intervals therearound and include support feet. These support feet are configured and positioned to cooperate with the interior walls of an associated enclosure when the device is inserted thereinto for maintaining the elongated member in some desired spaced relationship therein. Inwardly extending gripping means may be included on the collar interior for engaging the elongated member in the collar operative position for reducing the potential for relative movement therebetween. The alignment device preferably comprises a one piece molded plastic construction. Typically, a plurality of the devices are affixed to the elongated member at spaced intervals therealong for positioning it within an elongated enclosure over the coextensive lengths thereof.

22 Claims, 6 Drawing Figures

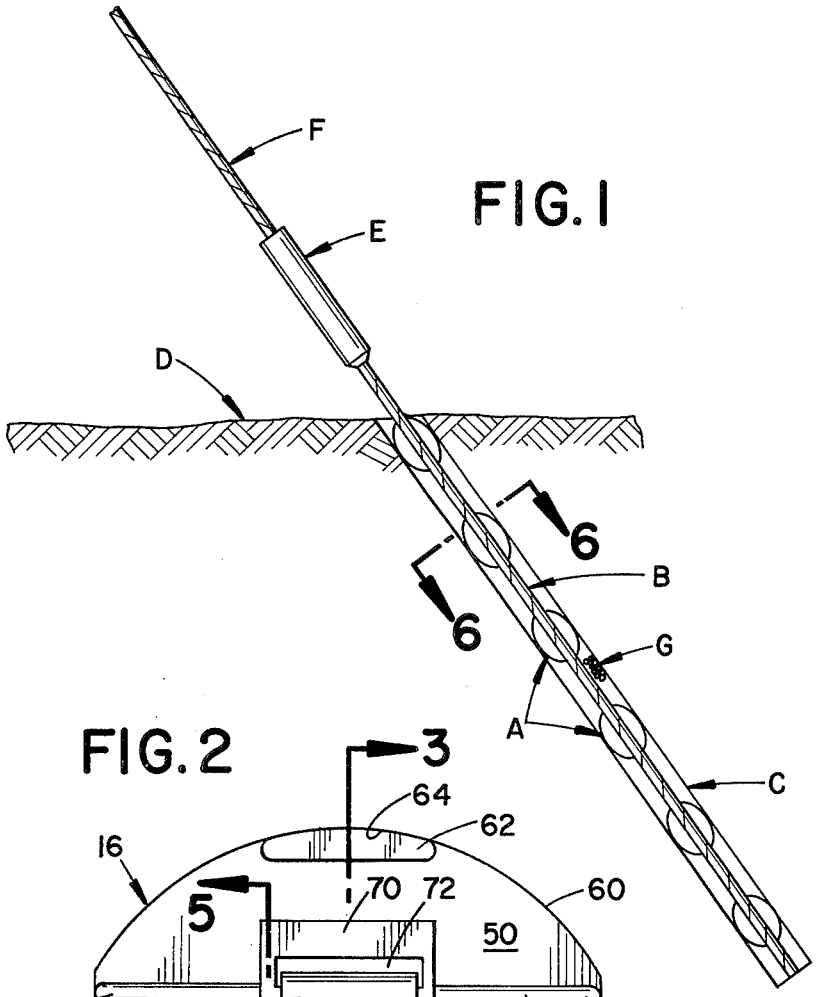
FIG. 1
FIG. 2
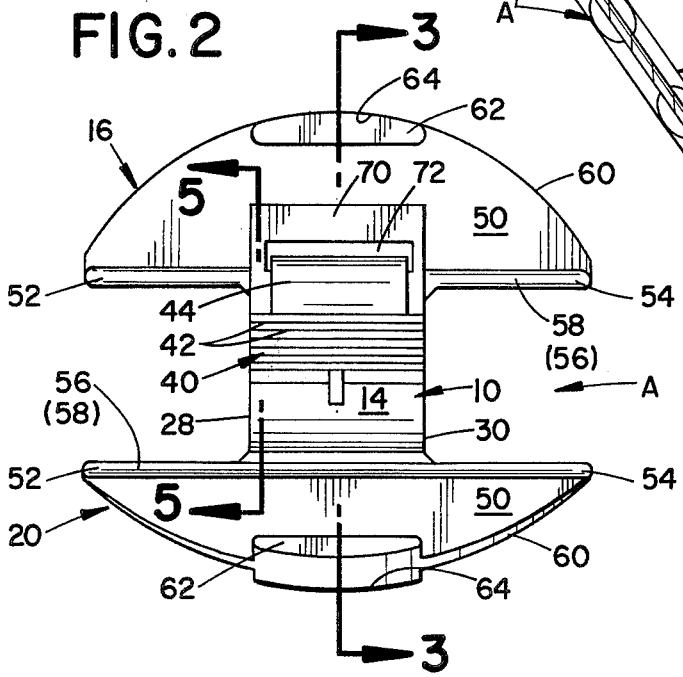

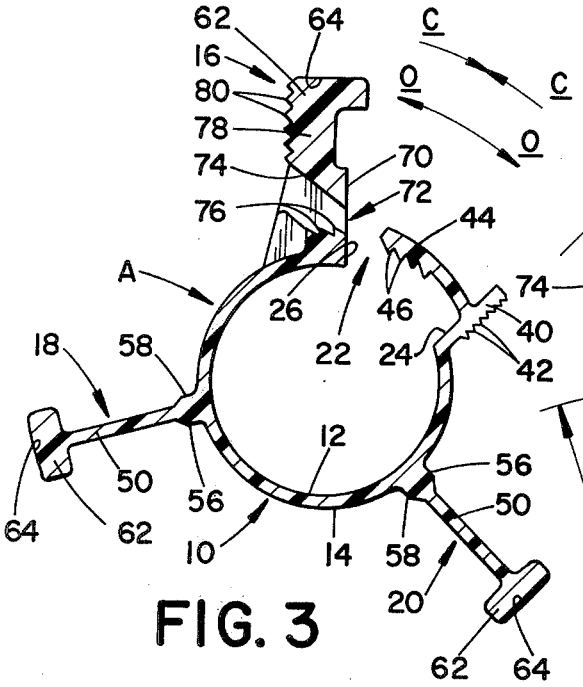
FIG. 3
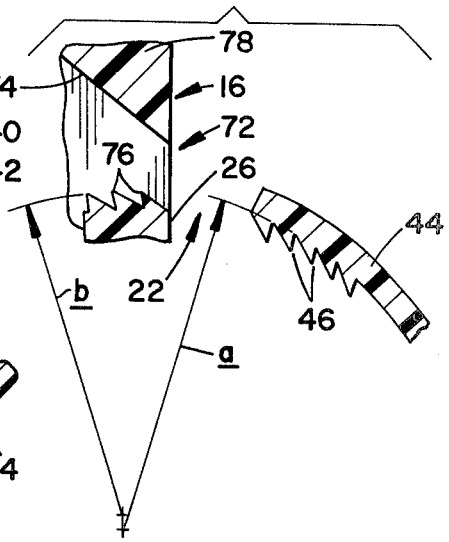
FIG. 4
FIG. 5
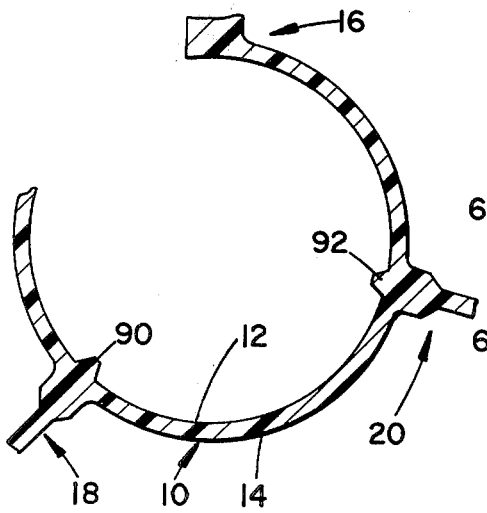
FIG. 6
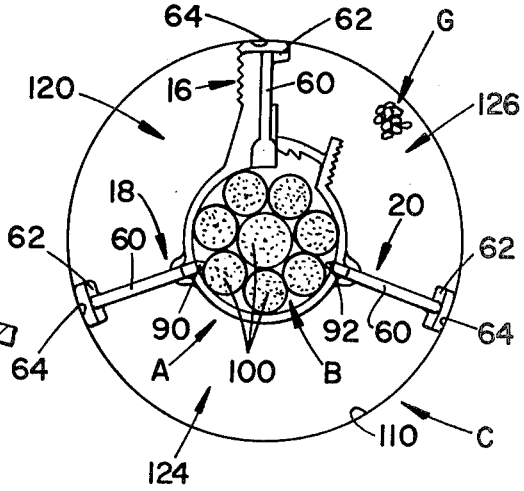

ALIGNMENT DEVICE

BACKGROUND OF THE INVENTION

This invention pertains to the art of alignment devices and more particularly to an alignment device for locating and retaining an elongated member at some predetermined position within an outer cover or enclosure.

The invention is particularly applicable to use in locating an anchor cable for guy lines within an elongated opening or hole extending beneath ground level and will be described with particular reference thereto. However, it will be readily appreciated by those skilled in the art that the invention has far broader applications and may be advantageously utilized for many other applications in many different environments where it is desired to locate some elongated member in a predetermined position within an associated housing or casing.

In anchoring some guy lines for electrical power line towers or the like, an elongated anchor cable for the guy line is fixedly secured in an axial disposition beneath ground level. The lower end of the guy line is fixedly secured to the top end of the anchor cable adjacent ground level. The number of such guy lines and anchoring devices is generally dependent upon the type and size of the tower itself. In some instances, however, the anchor cables will extend to a depth of up to sixty feet beneath the surface of the ground in order to provide the necessary anchoring strength. Typically, a hole or enclosure of the appropriate length is first drilled in the ground. Thereafter, the anchor cable is placed within the hole and the hole filled with a grout-like material for purposes of rigidly affixing the anchor cable therein. In order to obtain an optimum anchoring relationship between the anchor cable and hole or enclosure, it is desired that the anchor cable be centrally or coaxially positioned within the hole over the entirety of the coextensive lengths thereof. Since the length of the hole may, again, be as much as sixty feet, and since the anchor cable itself is somewhat flexible, a number of spacer or alignment members must be interposed between the anchor cable and hole at periodic intervals in order to maintain the desired relative positioning between the cable and hole. Such spacer or alignment members must also allow the grout-like material to be passed thereby in order to fill the hole or enclosure therewith.

There have heretofore been a number of different types and styles of such alignment devices employed in this particular environment. However, all of these devices have had certain drawbacks or disadvantages to their use. For example, some prior devices required that they be "strung" onto the anchor cable from one end thereof which required an inordinate amount of anchor cable preparation time. Moreover, if one or more of the alignment devices have to be subsequently removed for replacement, it was also necessary to remove all the adjacent previously or subsequently strung alignment devices. Some prior alignment devices included means for fixedly securing the alignment devices to the anchor cable at spaced locations therealong but here, again, an inordinate amount of anchor cable preparation time was required. Such securing means typically comprise tape, separate clamps and the like. Still other prior alignment devices did not facilitate ease of access to the elongated hole once the anchor cable and plurality of spaced apart alignment devices were inserted thereinto. This then caused difficulties with the proper and complete filling of the hole with grout-like material. Moreover, still other prior alignment devices included support leg constructions which engaged the hole or enclosure internal wall in a manner which caused binding therewith and, in some instances, damage to the spacers themselves. A still further disadvantage to prior alignment devices resides in the fact that some comprise multi-piece constructions necessitating difficult assembly onto the anchor cable.

On the basis of the foregoing problems, it has been considered desirable to develop a spacer or alignment device particularly adapted for use in guy line anchor cable applications which would meet and overcome the above noted problems. To that end, such a device would desirably accommodate installation generally transversely onto the anchor cable at some desired position therealong so as to eliminate the need for threading a plurality of the devices thereonto from one end thereof. The device should comprise a single component and should not require any separate parts or fastening means. Installation onto the anchor cable should be possible without the use of any special tools and preferably, with no tools at all. The device should also facilitate tight mounting thereof around the periphery of the anchor cable so that it cannot slip longitudinally or axially along the cable during cable installation into the casing. The means used to obtain a tight mounted relationship around the anchor cable should also facilitate some adjustment to take any variations in the anchor cable outside diameter into proper account. The alignment device should also be configured so that the anchor cable may be withdrawn from the hole or enclosure prior to grouting should such withdrawal become necessary for any reason. In that same vein, the alignment device itself should be readily removable from the anchor cable should it become necessary for any reason. The alignment device should also provide sufficient clearance between the outside diameter of the anchor cable and the hole internal wall to permit introduction of the grout-like material into the entire length of the hole. Finally, such a device should be readily slidable with the anchor cable into the hole to eliminate the potential for any binding during assembly.

The subject invention overcomes the foregoing problems and meets the above noted design criteria in providing an alignment device particularly useful in locating and mounting an anchor cable within an elongated anchor cable hole or enclosure in a guy line anchoring environment. However, the subject invention is also deemed equally applicable to use in aligning an elongated member within the interior of a housing or enclosure for varied applications in many different environments.

BRIEF DESCRIPTION OF THE INVENTION

In accordance with the present invention, there is provided a new and improved alignment device which allows an elongated member to be fixedly located in a predetermined desired position within the interior of an associated enclosure.

More particularly, the alignment device is comprised of a hollow collar adapted to be placed in a surrounding relationship with an axial section of an elongated member. The collar is generally longitudinally split so as to define a peripheral space between spaced apart opposed peripheral ends. These ends are adapted to be selectively moved apart from each other to assume a collar mounting position allowing the collar to be placed over a desired axial section of the elongated member and toward each other and to then be moved toward each other into a collar operative position wherein the collar is in a generally close surrounding relationship with the axial section. Locking means disposed adjacent the collar opposed peripheral ends permits selective locking of the collar in the operative position. A plurality of supporting legs extend outwardly from the collar a distance whereby the device is adapted to be received within the interior of an associated enclosure with the radial outermost ends of the supporting legs cooperating with the enclosure interior walls. This then allows the device to establish a predetermined located position for the elongated member within the enclosure.

In accordance with another aspect of the present invention, the supporting legs each have a length dimension extending generally longitudinally of the collar with the opposed longitudinal leg terminal ends disposed axially outward from an associated collar end face. In the preferred arrangement, each supporting leg includes an end edge extending arcuately outward from the collar between the leg terminal ends.

In accordance with another aspect of the present invention, the device further includes support feet disposed at the supporting leg outermost ends. These feet extend generally normally outward of the plane defined by the associated supported leg.

According to a further aspect of the invention, the locking means comprises a locking tang disposed adjacent to one of the collar peripheral ends extending over the slot toward the other of the collar peripheral ends. The locking tang includes a first locking member disposed therealong adapted to lockingly engage a second locking member adjacent the collar other peripheral end when the collar is moved toward its operative position. One of the first and second locking members is lockingly adjustable relative to the other to accommodate some variations in the outside cross-sectional dimension of the elongated member to which the device is to be attached.

According to yet a further aspect of the invention, the alignment device further includes means for preventing longitudinal displacement of the opposed collar peripheral ends relative to each other at least when the collar is in its operative position. In the preferred arrangement, this preventing means comprises having one of the supporting legs positioned adjacent the collar other peripheral end with this leg, in turn, including an opening therethrough. This opening is adapted to receive the locking tang at least when the collar is moved to the operative position and thereby prevent the relative longitudinal displacement.

In accordance with still another aspect of the present invention, the collar includes at least one gripping protrusion extending inwardly into the hollow internal area defined thereby. This at least one protrusion is adapted to engage the elongated member when the device is placed in the operative position on an axial section thereof and aids in reducing any potential for relative movement therebetween.

In the preferred arrangement, the device itself comprises a one piece molded plastic construction and the collar peripheral ends have a normal position spaced apart from each other. These ends may be resiliently deflected further apart relative to each other from the normal position for obtaining the collar mounting position and may then be resiliently deflected toward each other from the normal position for obtaining the collar operative position.

The principal object of the present invention is the provision of a new and improved alignment device for locating and maintaining an elongated member relative to the interior of an associated housing or enclosure.

Another object of the invention is the provision of an alignment device of the foregoing type which is simple to manufacture and easy to use.

Still another object of the invention is the provision of a new and improved alignment device which facilitates reliable installation on an elongated member which is to be axially received within an extremely elongated enclosure.

A further object of the present invention is the provision of such an alignment device which is readily adapted to varied alignment applications in many different environments.

Still other objects and advantages for the subject invention will become readily apparent to those skilled in the art upon a reading and understanding of the following specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein:

FIG. 1 is an overall view in partial cross-section of the preferred environment of use for the subject alignment device;

FIG. 2 is a side elevational view of the subject new alignment device;

FIG. 3 is a cross-sectional view taken along lines 3—3 of FIG. 2;

FIG. 4 is a slightly enlarged view of a portion of FIG. 3 showing the dimensional relationships between the locking members of the preferred locking means utilized with the device;

FIG. 5 is a cross-sectional view taken along lines 5—5 of FIG. 2; and, FIG. 6 is a cross-sectional view taken along lines 6—6 of FIG. 1.

DETAILED DESCRIPTION OF THE PREFERRED EMBODIMENT

Referring now to the drawings wherein the showings are for purposes of illustrating the preferred embodiment of the invention only and not for purposes of limiting same, the FIGURES show a plurality of identical alignment devices A secured to an elongated cylindrical anchor cable B and received within an elongated cylindrical hole or enclosure C. Both the hole and anchor cable extend beneath ground level D and a compression type fitting E is employed adjacent ground level to connect the upper end of anchor cable B to the lower end of a guy wire or cable F. Guy wire F extends to a tower or the like (not shown) for purposes of providing support therefor. A grout material G is forced into the interior of hole C and around the length of anchor cable B received therein for fixedly securing the anchor cable in the hole.

While the structural arrangement for the alignment device A to be described hereinafter is particularly adapted for use in the foregoing environment, it should be fully appreciated and understood by those skilled in the art that the device may also be advantageously utilized in various alignment or locating applications as between two components in many different environments. Moreover, and while the device to be described hereinafter is utilized to coaxially align anchor cable B within hole or enclosure C, it is also possible to design the device to obtain some other relative positioning between the components as may be desired and/or dictated by the particular application.

More particularly, and with principal reference to FIGS. 2 and 3, alignment device A includes a thin walled hollow, open ended collar generally designated 10 having an internal peripheral wall 12 and an external peripheral wall 14. The open ended cylindrical configuration defined by internal wall 12 is specifically adapted to accommodate an elongated member having a circular cross section. However, it will be readily appreciated by those skilled in the art that this internal configuration may be varied as deemed necessary and/or appropriate for purposes of accommodating elongated members having other cross-sectional configurations. In the preferred embodiment, the entirety of alignment device A comprises a one piece construction molded from a suitable plastic material such as acrylonitrile butidiene styrene. Such a construction provides sufficient rigidity for its supporting function while allowing some resiliency or flexibility for collar 10 in order that it may be moved between mounting and operative positions for installation purposes. Here also, it will be readily appreciated that other types of plastics and materials could be advantageously utilized as deemed necessary and/or appropriate to best accommodate a particular application.

With continued reference to both FIGS. 2 and 3, a plurality of supporting legs 16,18 and 20 extend generally radially outward from collar external peripheral surface 14. While three such legs are shown generally equidistantly spaced about the collar, a greater or lesser number of such legs may be utilized to accommodate a particular installation. Collar 10 includes a longitudinal slit through the side wall thereof with the longitudinal side edges of this slit defining opposed peripheral ends 24,26 for the collar. The collar also includes a pair of opposed end faces 28,30 with the axial length of the collar between these end faces being varied as necessary. In some instances, and by way of reference only, this axial length may be as little as 1"or so.

A tab-like member 40 extends outwardly a short distance from collar 10 adjacent and coextensive with peripheral end 24. The outward extent of member 40 is less than the radial extent of supporting legs 16,18 and 20. A plurality of gripping ridges 42 are included on the planar surface of the tab-like member which faces outwardly of slit 22 and these ridges extend generally longitudinally of the collar. Gripping ridges 42 serve a purpose which will become more readily apparent hereinafter. An elongated locking tang 44 extends outwardly from tab-like member 40 on the planar surface thereof facing collar peripheral end 26. This locking tang has a generally arcuate configuration (FIG. 3) over its outward extent from tab-like member 40. As shown in FIG. 3, the collar is in a normal, non-use position wherein locking tang 44 extends at least partially across longitudinal slit 22 between ends 24,26. In addition, a plurality of consecutive first locking teeth 46 are included on the lower planar surface of the locking tang and generally face the collar interior. These teeth each extend longitudinally of the collar itself and taper rearwardly back toward tab-like member 40.

With still continued reference to FIGS. 2 and 3, supporting legs 16,18 and 20 are substantially identical in overall construction so that description will only be made with reference to leg 20, it being appreciated that the other legs are identical thereto unless otherwise specifically noted. Leg 20 includes a planar body portion generally designated 50 having opposed longitudinal terminal ends 52,54 disposed longitudinally outward from end faces 28,30, respectively. Reinforcing ribs 56,58 are disposed on opposite sides of planar body portion 50 to extend longitudinally between terminal ends 52,54. These reinforcing ribs advantageously provide additional leg strength in order that the device may support the dead weight of anchor cable B within housing or casing C in the preferred arrangement here under discussion. Leg 20 has an outer edge 60 extending arcuately between terminal ends 52,54 and further includes a support foot or pad 62 adjacent the radial outermost portion thereof. As will be best seen in FIG. 3, support foot 62 includes an outermost support surface 64 which has a width substantially greater than the thickness of planar body portion 50. In addition, the longitudinal extent of this support face is arcuately compatible with outer edge 60 over the coextensive longitudinal areas thereof.

The maximum radial extents of the supporting legs and associated support feet are such that the alignment device may be closely slidably received in a cooperative relationship or condition with the interior side wall of an associated housing or enclosure, that is, hole or enclosure C in the preferred embodiment. Because of the arcuate configurations of leg outer edges 60 and support surfaces 64, only a small area of the supporting legs at the area of the support feet will actually engage the hole side wall as the device is axially inserted thereinto. The remainder of the overall arcuate configuration allows the device to be moved axially within the hole in either direction and presents no sharp surfaces which could cause binding therein. In addition, the width of support surfaces 64 further aid in such sliding action and distribute the contact and loading forces over a wider surface area.

Support leg 16 includes certain additional structural details for accommodating locking tang 44. More particularly, a boss-like area 70 is included on the side of planar body portion 50 thereof which faces locking tang 44. An elongated slot 72 disposed longitudinally of collar 10 extends through boss area 70 to selectively receive at least a portion of the locking tang when the collar is moved to the operative position. As best shown in FIG. 3, slot 72 includes a tapered top or upper wall 74. A plurality of second locking teeth 76 are disposed to extend longitudinally of collar 10 at the lower wall of slot 72 adjacent collar external surface 14. These second locking teeth taper in a direction generally opposite from first locking teeth 46 and are adapted to be selectively placed in locking engagement with teeth 76 in a manner which will become apparent hereinafter. A boss-like area 78 is disposed on the other side of planar body portion 50 of supporting leg 16 from boss 70 and is generally coextensive with the support foot or pad 62 associated therewith. The outer planar surface of this boss area includes a plurality of gripping ridges 80 extending generally longitudinally of collar 10 for cooperative use with gripping ridges 42 of tab-like member 40 as will become apparent.

With particular reference to FIG. 4, it will be noted that the root areas of first locking teeth 46 are generally disposed a radial distance a from the center axis of collar 10. Similarly, the outermost edges or crests of second locking teeth 76 are generally spaced a radial distance b from adjacent the center axis. The center of radius b is slightly offset generally toward peripheral end 26 of the collar and radial distance a is equal to radial distance b. Because of the foregoing dimensional relationships, teeth 46,76 will automatically become engaged with each other when locking tang 44 is moved through elongated slot 72. The preferred one piece plastic construction with the inherent limited resiliency thereby provided to the locking tang along with the above noted dimensioning characteristics are such to effectively facilitate this locking relationship. Also the tapered configuration of teeth 46,76 allows locking tang 44 to be easily inserted through slot 72 but will not allow withdrawal thereof in the opposite direction unless the locking tang is forced slightly upward so that teeth 46,76 become disengaged. However, it will be readily appreciated by those skilled in the art that many other types and styles of latching means as well as other dimensional relationships may be advantageously employed without departing from the overall intent or scope of the subject invention.

Moreover, when the collar is moved to the operative position with locking tang 44 received through slot 72, the end walls of the slot act as a retaining means to prevent axial displacement of collar peripheral ends 24,26 relative to each other. Such retaining means are extremely advantageous since relative displacement between peripheral ends 24,26 would cause undesired disengagement between first and second locking teeth 46,76. This then would allow collar 10 to be moved from an operative position back toward the normal position shown in FIG. 3.

FIG. 5 shows the inclusion of radial protrusions 90,92 extending inwardly from internal wall 12 into the hollow area defined by collar 10. In the preferred embodiment, these protrusions are generally pyramid or diamond-shaped and are generally radially aligned with supporting legs 18,20. Protrusions 90,92 are adapted to engage anchor cable B when the alignment device is installed thereon for purposes of reducing any potential for relative movement therebetween. This feature is deemed to be of importance in the preferred environment here under consideration since it is highly desirable to retain the supporting legs of adjacent alignment devices secured at spaced intervals along anchor cable B in substantial longitudinal alignment with each other. This relationship facilitates the ease of introduction of a grout-like material into elongated hole or enclosure C. It will be readily appreciated, however, that the protrusion or internal gripping means configurations as well as the locations therefor may be modified to accommodate a particular device application and environment of use wherein it is desired to reduce the potential for relative movement between the device itself and an associated elongated member. For example, a roughened surface for internal peripheral wall 12 may sometimes be used and in some cases, it may be desirable to entirely eliminate the protrusions or internal gripping means. Such modifications do not depart from the overall intent or scope of the present invention.

Referring again to FIG. 3, alignment device A is therein shown in its normal position. In order to install the device on an elongated member, it is merely necessary to force or bias opposed collar peripheral ends 24,26 apart from each other in the directions labeled o—o so as to assume a mounting position. Such spreading is to the extent required for allowing the device to be generally transversely passed onto the elongated member through longitudinal slit 22 between peripheral end 26 and the outermost terminal end of locking tang 44. Once so installed, the outward biasing force may be released and, due to the preferred plastic construction of the device, ends 24,26 will automatically move back toward each other to again at least substantially assume their original normal position. Thereafter, simultaneous pressure may be applied at gripping ridges 42 of tab-like area 40 and gripping ridges 80 of boss 78 to urge peripheral ends 24,26 in directions c—c until the collar closely surrounds and engages the elongated member in a collar operative position. With such movement in directions c—c, locking tang 44 passes through elongated slot 72 and first and second locking teeth 46,76 engage each other so as to retain the collar in the operative position closely surrounding the elongated member. Once the alignment device A has been so installed, these two components are ready for insertion into the associated enclosure in order that the elongated member may be physically located and retained in some desired position therein.

FIG. 6 shows the relative positioning of the components described hereinabove with reference to FIG. 1 for a single one of alignment devices A. In the preferred arrangement of use, anchor cable B is comprised of a plurality of helically wound wire strands generally designated 100. These strands thus define an elongated generally cylindrical member. The alignment device A is installed on anchor cable B in the manner described hereinabove with collar 10 being shown in its operative position closely surrounding the cable. In this position, protrusions 90,92 are received in different ones of the spiral groove defined between adjacent ones of strands 100 in order to substantially reduce and/or eliminate any potential for relative movement between device A and anchor cable B. With the alignment device disposed in the operative position shown in FIG. 6, the cooperative relationship between the locking tang and elongated slot in leg 16, again, prevents axial displacement of the collar opposed peripheral ends 24,26. As previously noted with reference to FIG. 1, a plurality of devices A are installed at spaced intervals along anchor cable B with supporting legs 16,18 and 20 of adjacent devices disposed in substantial longitudinal alignment with each other.

In FIG. 6, enclosure C is comprised of an elongated hole having an inner wall generally designated 110. The outermost radial dimensions of support surfaces 64 of the support feet are such that they may be placed in close sliding cooperative engagement with inner wall 110 as the alignment devices and anchor cable are inserted thereinto. The convenient manner provided for mounting the individual alignment devices on anchor cable B permit such mounting as the anchor cable is paid off a storage reel or the like and just prior to the time that portion of the anchor cable to which a particular alignment device is to be mounted is inserted into hole C.

As shown in the preferred environment of FIG. 6, annular spaces 120,124 and 126 are provided between alignment device supporting legs 16,18 and 20. These areas are adapted to receive hoses, tubes or the like which are inserted into hole C simultaneous with anchor cable B and alignment devices A. Once the anchor cable is fully inserted into the hole or enclosure the hoses or tubes are utilized to convey a grout-like material into the hole starting with the lowermost end thereof and proceeding upwardly toward the top. The supply hoses are withdrawn outwardly from the top of the casing as it is being so filled. The grout-like material fills the entirety of the hole and surrounds both cable B and the associated alignment devices A. When the material hardens, the components involved provide an integral anchoring construction. It will be appreciated, however, that in some alternative applications for the alignment device, no grout-like material will be involved. In that case, general alignment between the supporting legs of the adjacent devices is not necessarily required.

While the subject invention has been described with reference to locating an elongated member coaxially within an associated elongated hole or enclosure, it will be readily appreciated that other relative located positions may be advantageously achieved by simply modifying the length and/or configurations of the collar supporting legs. Moreover, and while an elongated cylindrical enclosure and cylindrical elongated member have been specifically described, it will be appreciated that the concepts of the subject invention are readily and equally adapted to use with enclosures, housings and elongated members having other and varied cross-sectional configurations. Here too, it is merely necessary that appropriate modifications be made to the structure of the collar and/or to the configuration or orientation of the supporting legs. Such modifications, as well as application of the device to other applications in different environments, are not deemed to in any way depart from the overall intent or scope of the present invention.

The invention has been described with reference to the preferred embodiment. Obviously, modifications and alterations will occur to others upon a reading and understanding of the specification. It is our intention to include all such modifications and alterations insofar as they come within the scope of the appended claims or the equivalents thereof.

Having thus described our invention, we now claim:

1. An alignment device adapted to position an elongated member in some predetermined manner within the interior of an associated enclosure, said alignment device comprising:

a hollow collar adapted to be placed in a surrounding relationship with an axial section of an elongated member, said collar being generally longitudinally split to define a peripheral space between spaced apart opposed peripheral ends, said ends adapted to be selectively moved apart from each other to assume a collar mounting position allowing said collar to be placed over a desired axial section of the elongated member and to then be moved toward each other into a collar operative position wherein said collar is in a generally close surrounding relationship with the axial section;

locking means disposed adjacent said collar opposed peripheral ends for permitting selective locking of said collar peripheral ends in said operative position; and, a plurality of supporting legs extending outwardly from said collar a distance whereby said device is adapted to be received within the interior of an associated enclosure with the outermost ends of said supporting legs cooperating with the interior walls of the enclosure to establish a predetermined position for the elongated member therein.

2. The alignment device as defined in claim 1 wherein said spacing legs extend generally radially outward from said collar at spaced intervals therearound.

3. The alignment device as defined in claim 1 wherein said supporting legs each have a length dimension extending generally longitudinally of said collar with opposed longitudinal leg terminal ends disposed axially outward from an associated collar end face.

4. The alignment device as defined in claim 3 wherein said supporting legs each have a substantially planar configuration including an end edge extending arcuately outward from said collar between said leg terminal ends.

5. The alignment device as defined in claim 3 further including support feet disposed at said supporting leg outermost ends, said feet extending generally normally outward of the plane defined by the associated supporting leg.

6. The alignment device as defined in claim 1 wherein said locking means comprises a locking tang disposed adjacent one of said collar peripheral ends extending over said slot toward the other of said collar peripheral ends, said locking tang including a first locking member disposed therealong adapted to lockingly engage a second locking member adjacent said collar other peripheral end when said collar is moved toward said operative position.

7. The alignment device as defined in claim 6 wherein said first and second locking members comprise first and second locking teeth configured to cooperably engage each other when said collar is moved toward said operative position.

8. The alignment device as defined in claim 7 wherein at least one of said first and second locking teeth comprises a plurality of such teeth disposed in consecutive rows relative to each other to accommodate selective adjustability of said collar operative position.

9. The alignment device as defined in claim 6 further including means for preventing longitudinal displacement of said opposed collar peripheral ends relative to each other at least when said collar is in said operative position.

10. The alignment device as defined in claim 9 wherein said preventing means comprises having one of said supporting legs positioned adjacent said collar other peripheral end, said one supporting leg including an opening therethrough adapted to receive said locking tang at least when said collar is moved into said operative position to thereby prevent such relative longitudinal displacement.

11. The alignment device as defined in claim 6 further including a tab-like member extending outwardly of said collar adjacent said collar one peripheral end with said locking tang extending outwardly from said tab-like member toward said collar other peripheral end.

12. The alignment device as defined in claim 1 further including at least one gripping protrusion extending inwardly into the hollow internal area defined by said collar, said protrusion adapted to engage the elongated member when said collar is placed in said operative position on an axial section thereof to thereby aid in at least reducing any potential for relative movement therebetween.

13. The alignment device as defined in claim 1 wherein said device comprises a one piece molded plastic construction with said collar peripheral ends having a normal position spaced apart from each other, said ends being resiliently deflected further apart relative to each other from said normal position for obtaining said collar mounting position and said peripheral ends being resiliently deflected further toward each other from said normal position for obtaining said collar operative position.

14. An arrangement for maintaining an elongated member in some predetermined desired position within a hollow receiving enclosure, said arrangement comprising in combination:

an outer enclosure including a receiving passage therein defined by a passage side wall having a first cross-sectional dimension;

an elongated member having a second cross-sectional dimension less than said first cross-sectional dimension with at least a portion of said elongated member generally axially received in said receiving passage; and, at least one alignment device interposed between said elongated member and said receiving passage side wall for maintaining said elongated member in a predetermined position within said receiving passage, said device including a hollow collar disposed in an operative position generally surrounding an axial section of said elongated member and supporting legs disposed in supporting cooperation between said collar and said receiving passage side wall, said collar being generally longitudinally split to define a peripheral space between spaced apart opposed peripheral ends for allowing said peripheral ends to be selectively moved apart from each other in order that said device may be placed in a cooperative condition with said elongated member axial section prior to insertion of said elongated member and device into said receiving passage; locking means disposed adjacent said collar peripheral ends for locking said collar in said operative position; and, a plurality of said supporting legs disposed at spaced intervals around said collar to extend outwardly therefrom, said supporting legs being dimensioned so that the outermost ends thereof cooperative with said receiving passage side wall for positively locating said elongated member in a predetermined position relative thereto.

15. The combination as defined in claim 14 wherein said supporting legs each have a length dimension extending generally longitudinally of said collar with opposed longitudinal leg terminal ends disposed axially outward from an associated collar end face.

16. The combination as defined in claim 15 further including support feet at said supporting leg outermost ends, said feet having arcuate outermost surface configurations extending generally longitudinally of said collar and cooperating with said receiving passage side wall.

17. The combination as defined in claim 14 wherein said locking means comprises a locking tang disposed adjacent one of said collar peripheral ends extending over said slot toward the other of said collar peripheral ends, said locking tang including a first locking member disposed therealong in locking engagement with a second locking member disposed adjacent said collar other peripheral end for retaining said collar in said operative position generally surrounding said elongated member.

18. The combination as defined in claim 17 further including means for preventing longitudinal displacement of said opposed collar peripheral ends relative to each other at least when said collar is in said operative position.

19. The combination as defined in claim 18 wherein said preventing means comprises having one of said supporting legs positioned adjacent said collar other peripheral end, said one supporting leg including an opening receiving said locking tang therethrough at least when said collar is in said operative position.

20. The combination as defined in claim 14 wherein said collar further includes at least one gripping protrusion extending into the hollow area defined by said collar, said protrusion engaging said elongated member to aid in at least reducing any potential for relative movement therebetween.

21. The combination as defined in claim 14 wherein said receiving passage is axially elongated and a plurality of said alignment devices are interposed between said elongated member and receiving passage side wall at spaced intervals over the coextensive lengths thereof.

22. The combination as defined in claim 14 wherein said alignment device comprises a one piece molded plastic construction, said collar adapted to be resiliently deformed so that said collar peripheral ends may be moved apart from each other to accommodate mounting of said alignment device into said cooperative condition with said elongated member axial section and to thereafter be resiliently deformed so that said collar peripheral ends are moved toward each other to obtain said collar operative position.

* * * * *